US005967701A

United States Patent [19]

Berkley et al.

[11] Patent Number: 5,967,701

[45] Date of Patent: Oct. 19, 1999

[54] BARRIER ELEMENT, SYSTEM, METHOD AND CONNECTOR THEREFOR

[76] Inventors: David M. Berkley; Lorraine F. Berkley, both of 122 Winne Rd., Delmar, N.Y. 12054

[21] Appl. No.: 09/027,329

[22] Filed: Feb. 20, 1998

Related U.S. Application Data

[63] Continuation of application No. 08/743,198, Nov. 5, 1996.

[51] Int. Cl.[6] ..... E02D 5/08

[52] U.S. Cl. ..... 405/281; 405/274

[58] Field of Search ..... 405/272, 273, 405/274, 276, 277, 278, 279, 280, 281

[56] References Cited

U.S. PATENT DOCUMENTS

| | | | |
|---|---|---|---|
| 1,098,077 | 5/1914 | Annison | 405/279 |
| 1,681,593 | 8/1928 | Pahl | 405/279 |
| 2,018,446 | 10/1935 | Jensen | 405/281 |
| 2,020,315 | 11/1935 | Hughes | 405/278 |
| 3,141,305 | 7/1964 | Schenk | 405/255 |
| 3,688,508 | 9/1972 | Taylor | 405/279 |
| 4,050,254 | 9/1977 | Meheen et al. . | |
| 4,503,649 | 3/1985 | Sciortino . | |
| 4,690,588 | 9/1987 | Berger | 405/278 |
| 4,707,962 | 11/1987 | Meheen . | |
| 5,030,034 | 7/1991 | Bodine | 405/276 |
| 5,066,353 | 11/1991 | Bourdo . | |
| 5,134,815 | 8/1992 | Pickett . | |
| 5,145,287 | 9/1992 | Hooper et al. . | |
| 5,292,208 | 3/1994 | Berger | 405/281 |
| 5,337,527 | 8/1994 | Wagenaar . | |
| 5,406,745 | 4/1995 | Lin . | |
| 5,456,555 | 10/1995 | Bokeler . | |
| 5,469,655 | 11/1995 | Lin . | |
| 5,499,891 | 3/1996 | Klenert . | |
| 5,536,111 | 7/1996 | Doernemann . | |

*Primary Examiner*—David J. Bagnell
*Assistant Examiner*—Frederick L Lagman
*Attorney, Agent, or Firm*—Schmeiser, Olsen & Watts

[57] ABSTRACT

An apparatus and a method for stabilizing sloped embankments is disclosed which utilizes interlocking barrier elements to form a step-like, cascading barrier to erosion and to provide an inexpensive, easy-to-install and aesthetically attractive landscaping wall, planter or landscaping island. The scallop or channel-like shape of the barrier elements creates filler spaces which may be filled with concrete, soil or other filler materials and in which vegetation may be planted. A row of barrier elements within the system may be locked in place by slip restraint devices which function to prevent vertical slippage of the rows. Adjacent barrier elements on the front most row are held together by frontal locking elements. Also disclosed is a barrier element, system and method. The barrier elements have complementary male and female portions. The connectors allow for use of a single barrier element shape to inexpensively create cascading slope armoring barriers, barrier walls and containment structures.

30 Claims, 9 Drawing Sheets

FIG. 2
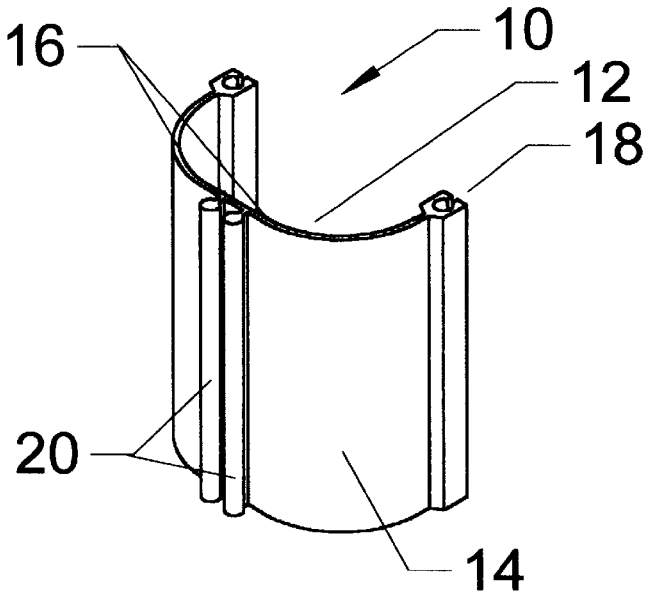
FIG. 3
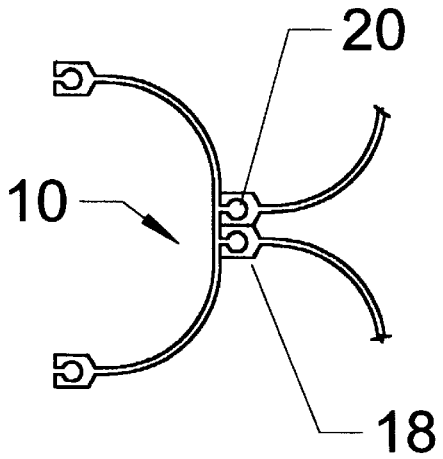
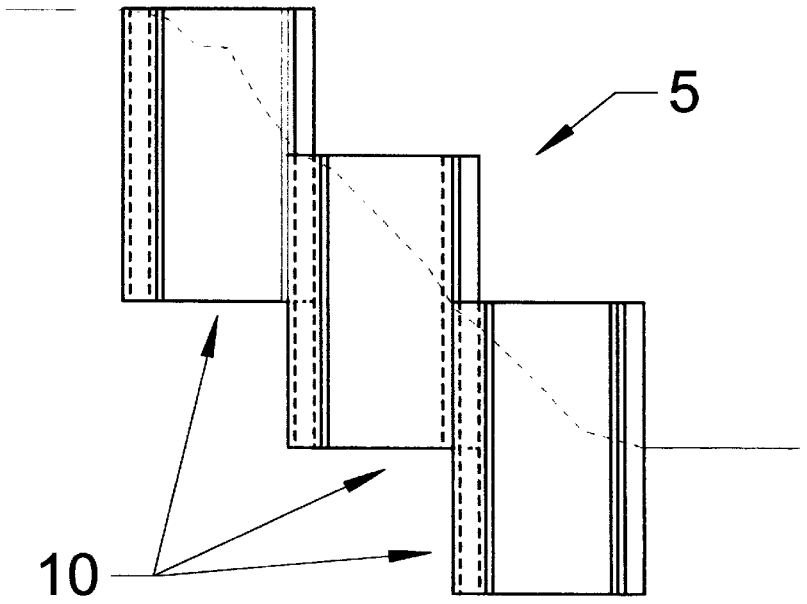
FIG. 4

FIG. 5
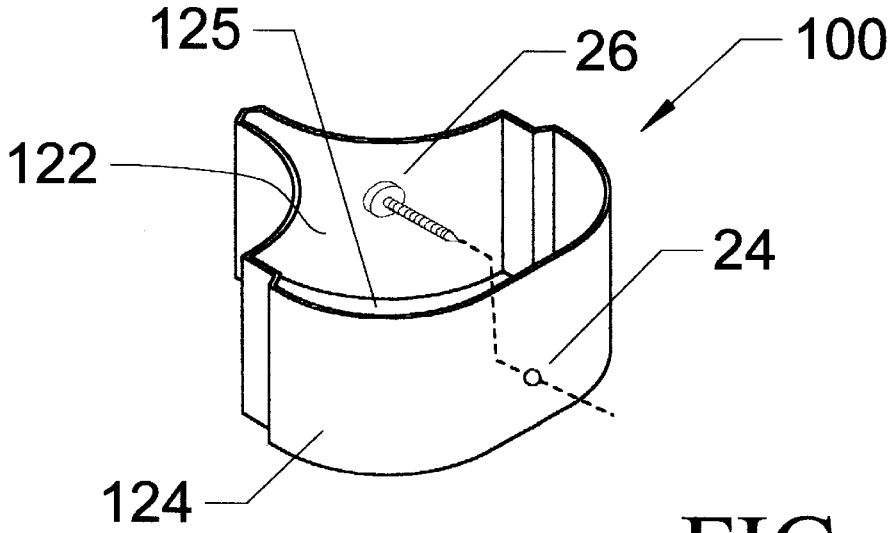
FIG. 6
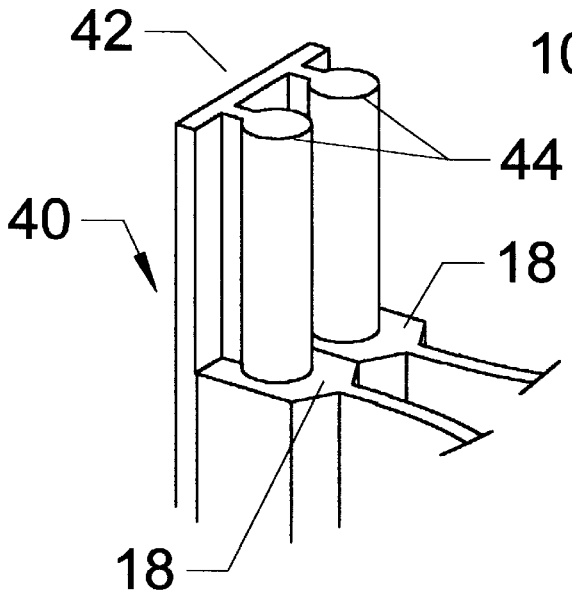
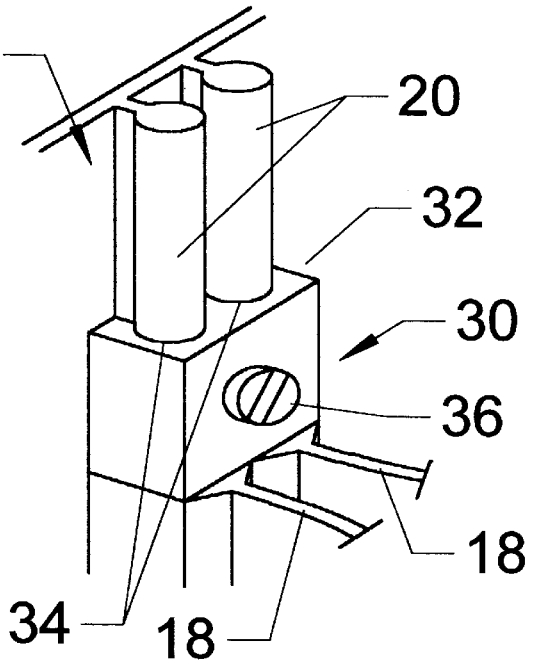
FIG. 7

FIG. 8
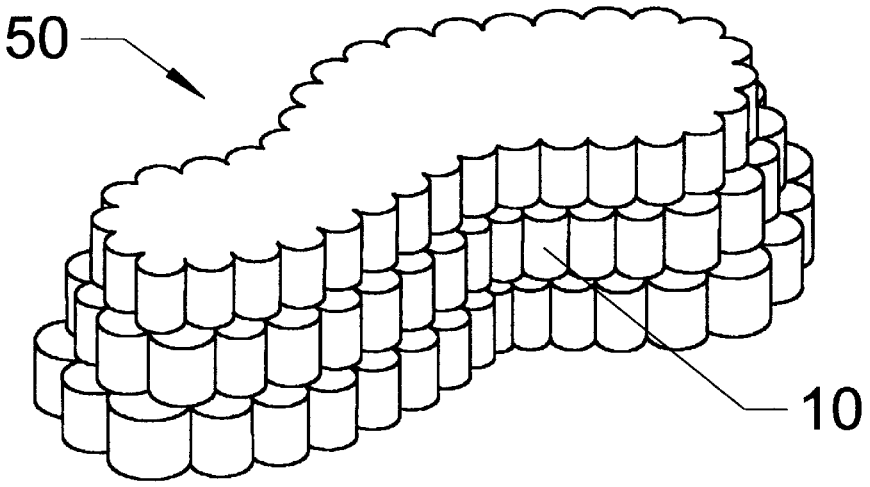
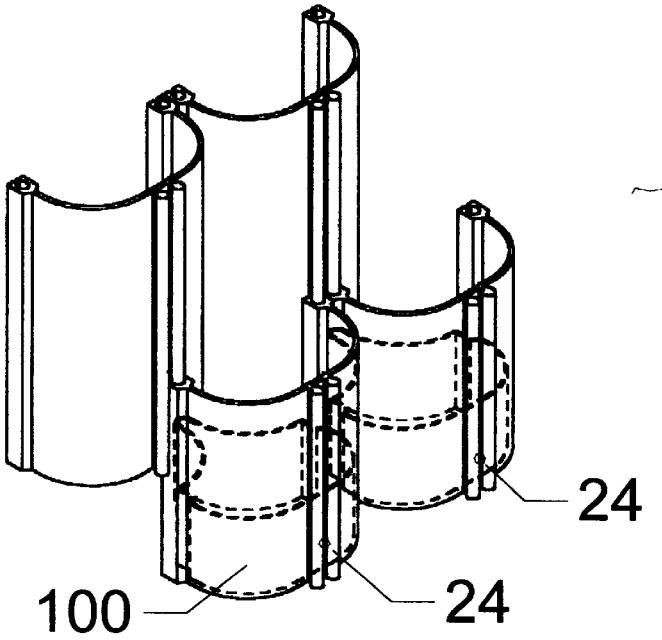
FIG. 10
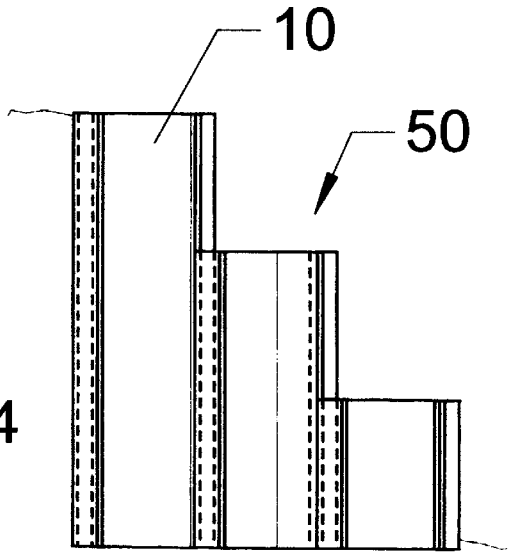
FIG. 9

BARRIER ELEMENT, SYSTEM, METHOD AND CONNECTOR THEREFOR

This application is a continuation of Ser. No. 08/743,198, filed Nov. 5, 1996, and currently pending. That prior application is incorporated by reference herein.

FIELD OF THE INVENTION

The present invention relates generally to erosion control systems, and more specifically to landscaping barriers and a method for stabilizing sloped embankments. Further, the present invention relates to a barrier element and connector therefor, and a system and method for granular material containment.

BACKGROUND OF THE INVENTION

Often when landscaping terrain, it is desirable to create a change in elevation between two distinct land areas using a steep slope or an encompassing embankment. The grade or angle of the slope or embankment rising off a horizontal plain often exceeds the natural angle of repose of the slope or embankment. This makes the slope or embankment susceptible to the erosion or sloughing off of its surface due to its own weight or erosion of its surface by water from rain or irrigation. The instability of a steep slope or embankment surface makes it difficult to maintain. Furthermore, such an unstable surface hinders the growth of stabilizing vegetation.

Typically, stabilization of a steep slope or embankment is accomplished by covering the surface with a structural facing keyed into the toe of the slope. This serves to control sloughing and/or erosion. Another approach has been to replace the slope with a structural retaining wall having a relatively vertical face. However, these types of solutions are often aesthetically displeasing and restrictive to the landscaper because they force the shape of the slope or embankment to conform to the surface shape and texture of the chosen surface protection structure and restrict the growth of vegetation (a natural slope stabilizer) over the surface of the slope or embankment.

Additionally, the above solutions (and others) may require construction skills beyond that of the amateur landscaper; they may be permanent structures requiring continuing costly maintenance; or they may be cost prohibitive due to the manufacturing or construction costs.

A number of devices attempt to resolve the problems associated with stabilizing sloped embankments. Among these are U.S. Pat. No. 4,050,254 to Meheen et al., U.S. Pat. No. 4,503,649 to Sciortino, U.S. Pat. No. 4,707,962 to Meheen, U.S. Pat. No. 5,066,353 to Bourdo, U.S. Pat. No. 5,134,815 to Pickett, U.S. Pat. No. 5,145,287 to Hooper et al., U.S. Pat. No. 5,337,527 to Wagenaar, U.S. Pat. No. 5,456,555 to Bökeler, and U.S. Pat. No. 5,536,111 to Doernemann.

U.S. Pat. No. 4,050,254 to Meheen et al. discloses a modular assembled retaining wall which is constructed by founding a plurality of precast tie-back elements in laterally spaced relationship along a grade line. This, however, necessitates considerable reshaping of the embankment because the tie-back means extend vertically back into the embankment, thus requiring either that they be driven back into the soil or that a substantial amount of soil be used to cover each horizontal tier as it is created.

U.S. Pat. No. 4,503,649 to Sciortino discloses premanufactured modular blocks which may interlock to form breakwaters, harbor dams and the like. The modular blocks involve a cylindrical element and a wing arranged substantially at half height of the cylindrical body. The wing is provided with an open cavity arranged to embrace the cylindric element of similar blocks. These modular blocks, however, provide no means whereby vegetation could be grown were they used for stabilizing an embankment.

U.S. Pat. No. 4,707,962 to Meheen discloses a cascade wall structure made up of generally rectangular members with end ribs and curved panels having curved ends which interlock with curved surfaces on the ribs of the members for creating a variety of wall structures for different purposes and uses. These devices, however, are relatively complex and therefore may lack utility for persons not experienced in construction.

U.S. Pat. No. 5,066,353 to Bourdo discloses a shoreline prevention bulkhead system which employs a series of interlocking fiberglass panels. Each panel has elongated male and female interlocking elements extending along the opposite side edges such that, by introducing one end of the male interlocking element of a first panel into an adjacent panel and sliding the interlocking elements together, a secure panel joint is achieved. However, these panels do not allow for any sloping of the embankment.

U.S. Pat. No. 5,134,815 to Pickett discloses a barrier structure including at least one panel disposed to extend generally along a fence line, the panel having an engaging element for pivotal joining of the panel to a member of the structure. Again, like Bourdo and Hooper, using a panel to form a barrier effectively precludes sloping of the embankment.

U.S. Pat. No. 5,145,287 to Hooper et al. discloses plastic panels and a ground erosion barrier made therefrom. The panels are configured in a stretched Z-shape cross sectional design with opposed male and female interlock edges for mating association with adjacent panel strips. As with the Bourdo device described above, this barrier does not allow for any sloping of the embankment.

U.S. Pat. No. 5,337,527 to Wagenaar discloses a building block that requires conforming the slope or embankment surface shape both vertically and horizontally to the constant vertical slope built into the system and a strict adherence to installing the system in stacked level layers. In addition, the block prohibits the growth of vegetation within the limits of the systems surface.

U.S. Pat. No. 5,456,555 to Bökeler discloses a structural set of angle elements fitting into one another. The set consists of a system of commonly shaped elements having only an incremental ability to conform to changes in the vertical grade of a slope and requires a strict adherence to the installation of the system in stacked level layers. Both of these attributes will require conforming the slope or embankment's surface shape to that of the installed system.

U.S. Pat. No. 5,536,111 to Doernemann discloses an adjustable erosion control wall including a plurality of individual panels, each panel having a tongue projecting from one end and a groove formed in the opposite end. The panels of the retaining wall are pivotally and vertically slidably connected with the tongue of one panel engaged within the groove of an adjacent panel. This device possesses the same weaknesses as those discussed immediately above.

The above reference summaries are only representative of the elements disclosed in each reference. Each reference should be read individually for what it actually teaches. The references described above are considered pertinent to the disclosure and are hereby incorporated by reference. However, in spite of the existence of these devices for stabilizing embankments, controlling erosion and other similar uses, most of these devices are either too complex or too expensive for lay people to implement, or are composed of assemblies of vertical panels, which precludes any sloping of the embankment as might be desirable in various landscaping implementations. Further, these devices are not overly versatile in that they are only usable for earthen embankment stabilization.

SUMMARY OF THE INVENTION

The present invention effectively stabilizes a slope or embankment without requiring excessive reshaping of the slope or embankment, without precluding a sloping of the embankment, and without the high manufacturing and construction costs associated with many erosion control or stabilization devices. Furthermore, the present invention enables the growth of vegetation on the slope or embankment, which will serve as additional protection against erosion.

This invention involves an apparatus and method for stabilizing sloped soil embankments and the like, for creating terrace planters on sloped embankments, and for creating freestanding soil filled planters or soil filled landscaping islands. The invention utilizes interlocking scallop or channel-shaped devices which interlock in a step-like or cascading fashion to form a barrier which will stabilize a slope. When interlocked in this manner, the devices may be filled with concrete or soil. If soil is used, vegetation may be planted therein to further deter erosion. Because the devices are simple to interlock and are composed of inexpensive materials, they can be obtained and installed with relatively low cost and effort.

This invention includes a method for stabilizing slopes or embankments using a system of interconnected elements of a common shape that will conform to the desired slope or embankment shape in three dimensions.

The barrier devices which, when interconnected to form a barrier, still allow for sloping of the embankment at virtually any desirable angle.

The barrier devices when interconnected form a slope or embankment stabilization system that allows the growth of vegetation throughout the limits of its installation for aesthetic reasons and to take advantage of the natural slope stabilization benefits provided by vegetation's roots.

This invention provides a slope or embankment stabilization system with components of such weights and dimensions that they can be transported and installed by an amateur landscaper, removing the need for special construction equipment or heavy machinery.

This invention includes a slope or embankment stabilization system requiring minimal construction skills, no additional materials beyond the system's few components and an infill material such as the natural soil of the slope or embankment, gravel, or ready mixed concrete, allowing the system to be installed by an individual without outside labor forces if desired.

This invention includes a slope or embankment stabilization system capable of encompassing isolated land areas to create free standing soil filled landscaping islands or smaller soil filled planters.

In a first general aspect in accordance with a preferred embodiment of the present invention is provided: a barrier element comprising a barrier member, and a connector positioned on at least one end of the barrier member, the connector having a male portion and a complementary female portion. Further, in one preferred embodiment of many possible forms, the male portion is T-shaped and the female portion is C-shaped such that the T-shape mates with an interior of the C-shape. This aspect allows for the interconnection of multiple barrier elements. The interconnected barrier elements then have a variety of uses, such as, stabilization of earthen embankments and the creation of a variety of self-supporting granular material containers which may be formed into islands if so desired. Further, this aspect allows the above structures to be built from a single barrier element shape.

In a second general aspect in accordance with a preferred embodiment of the present invention is provided: a system for containing formable material comprising a plurality of barrier members each having a connector on at least one end thereof, each connector having a male portion and a complementary female portion, wherein the barrier members interconnect with one another. This aspect creates a variety of surface barrier and surface armoring structures.

In a third general aspect in accordance with a preferred embodiment of the present invention is provided a method for formable material containment comprising the steps of providing a plurality of barrier members each having a connector on at least one end thereof, each connector having a male portion and a complementary female portion, and forming a series of compartments by interconnecting the barrier members. This aspect provides the advantage of being able to create formable material containment structures either in conjunction with material embankments or as individual freestanding containment structures for landscaping or material storage.

In a fourth general aspect in accordance with a preferred embodiment of the present invention is provided a connector system for members to be connected together, the system comprising a member, and a connector positioned on at least one end of the member, each connector having a male portion and a complementary female portion. This aspect provides a system of connecting members together which allows for a much larger variety of interconnections. Further, this aspect provides the option of using a single element in multiple orientations within the related system.

The foregoing and other features and advantages of the invention will be apparent from the following more particular description of preferred embodiments of the invention.

BRIEF DESCRIPTION OF THE DRAWINGS

These and other advantages of the present invention will become more apparent upon further examination of the drawings wherein:

FIG. 2 is a perspective view of a barrier element in accordance with a preferred embodiment of the present invention;

FIG. 3 is a top plan view of a barrier element in accordance with a preferred embodiment of the present invention depicting its interconnection with two other barrier elements;

FIG. 4 is a side view of a barrier wall of a preferred embodiment of the present invention depicting three interconnected barrier elements in relation to each other and to an embankment;

FIG. 5 is a perspective view of an infill drainage plug;

FIG. 6 is a perspective view of a slip restraint device as applied to one of three interconnecting barrier elements;

FIG. 7 is a perspective view of a frontal locking element in accordance with a preferred embodiment of the present invention;

FIG. 8 is a landscaping island;

FIG. 9 is a side view of a system for stabilizing slopes of a preferred embodiment of the present invention;

FIG. 10 is an infill drainage plug installed in a landscaping scallop;

DETAILED DESCRIPTION OF THE PREFERRED EMBODIMENTS

Although certain preferred embodiments of the present invention will be shown and described in detail, it should be understood that various changes and modifications may be made without departing from the scope of the appended claims. The scope of the present invention will in no way be limited to the number of constituting components, the materials thereof, the shapes thereof, the relative arrangement thereof, etc., and are disclosed simply as an example of the preferred embodiment.

Figure 1:
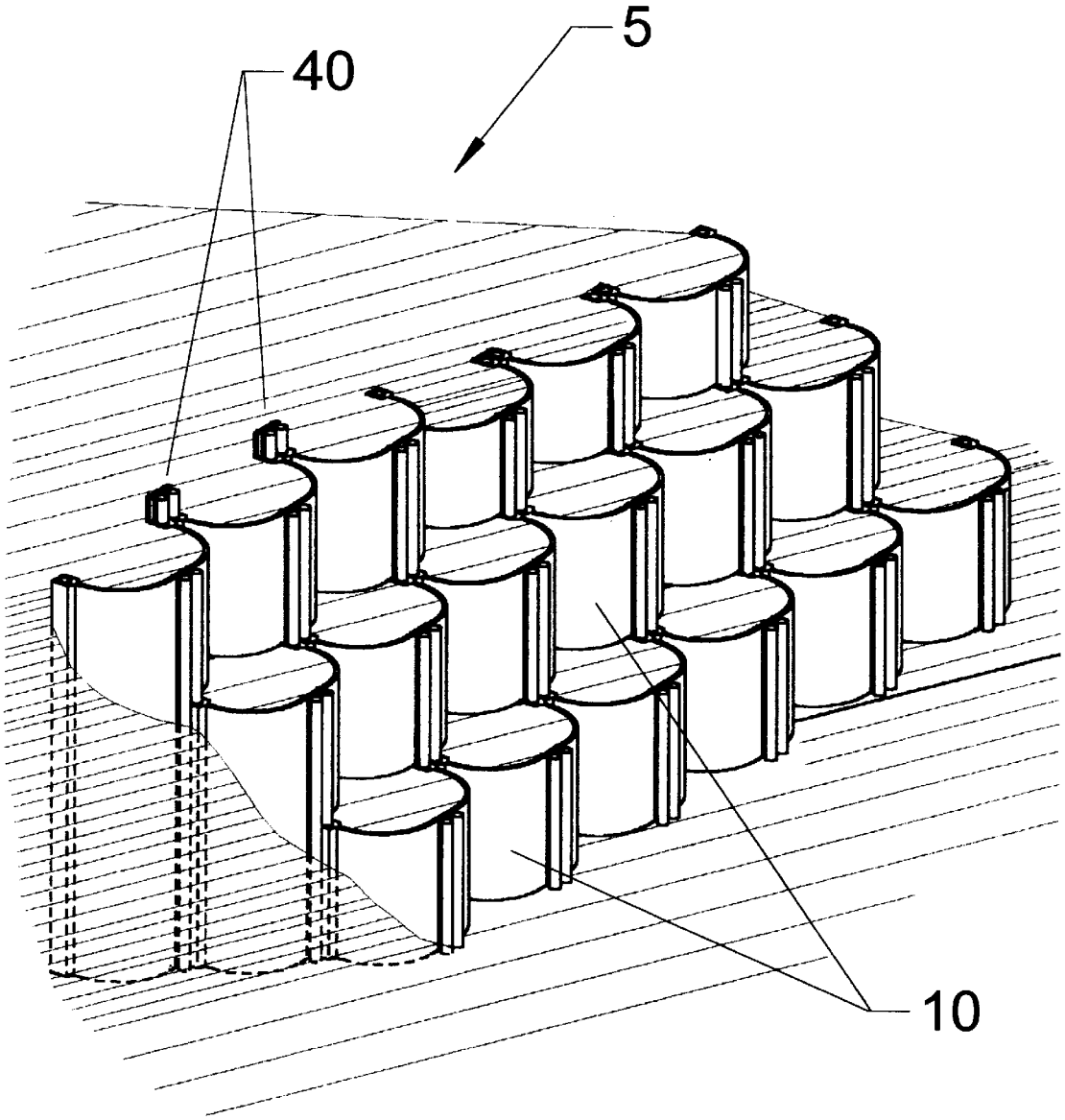
FIG. 1 is a perspective view of a segment of installed barriers in accordance with a first preferred embodiment of the present invention.

Referring now to FIG. 1, a perspective view of a barrier wall 5 is shown in accordance with a first preferred embodiment of the present invention. In this embodiment, the barrier elements 10 are scallop, U-shaped or channel shaped and are interconnected in a step-like and cascading fashion to form the barrier wall 5 as shown. Also depicted in FIG. 1 are locking elements 40, which tie together the topmost barrier elements 10. Although this depiction shows three rows of interconnected barrier elements 10, any number of barrier elements 10 may be used in a virtually endless number of combinations to form the desired barrier wall 5.

Referring to FIG. 2, a single barrier element 10 is shown in accordance with a first preferred embodiment of the present invention. Although in this embodiment the barrier element 10 is scallop-shaped, numerous shapes (e.g., triangular, square, etc.) could be utilized while preserving the interlocking function of the barrier element. The element 10 has a concave interior 12 and a convex exterior 14, which combine to form two arms 16, each arm ending with a female connector 18. Two male connectors 20, in this embodiment comprising narrow cylinders, run parallel down the center of the convex exterior 14 of the barrier element 10.

FIG. 3 is a top plan view, showing a barrier element 10 interconnected to the female connectors 18 by means of its male connectors 20. FIG. 4 depicts a side view of a barrier wall 5 with multiple rows of interconnected barrier elements 10. This figure shows the step-like fashion in which barrier elements 10 are arranged in order to create a sloping barrier wall 5.

FIGS. 5 and 10 depict an infill drainage plug 100 which includes filler space 122. The space 122 is bounded by a perimeter wall 124, following the perimeter of the horizontal cross-section of the void between barrier elements 10, and a bottom 125. The filler space 122 is open to the void between barrier elements 10 that exists above the infill drainage plug 100 which may be infilled with soil, concrete or any other infill material in accordance with an installer's individual preferences.

Also shown in these figures is a fastening means 26 placed in pilot hole 24 and passing into the wall of a barrier element 10 for the purpose of holding the infill drainage plug 100 in place. A barrier wall will normally contain several barrier elements 10 with filled drainage plugs 100 which will be at the bottom of each void created between barrier elements 10 retaining infill material.

FIG. 6 depicts a slip restraint device 30. This device comprises a main body 32, two female connectors 34 which interconnect with the male connectors of the barrier elements 10 and a fastening means 36. The slip restraint device 30 is interconnected with both male connectors 20 of a barrier element 10 after a female connector 18 of two other barrier elements 10 are interconnected to those male connectors 18. The slip restraint device 30 is pushed down flush against the top of the female connectors 18 and tightened using the fastening means 36. In this position, the slip restraint device 30 will prevent vertical slippage and thus maintain the shape of the barrier wall 5.

FIG. 7 is a perspective view of a frontal locking element 40. A frontal locking element 40 comprises a main body 42 and two male connectors 44. These male connectors 44 interlock with female connectors 18 of two adjacent barrier elements 10, thus locking together the foremost row of barrier elements 10.

FIG. 8 shows a possible arrangement of barrier elements 10 to form a planter or landscaping island 50 which can be assembled in a variety of sizes and shapes to accommodate individual tastes. FIG. 9 is a cross sectional depiction of the planter or landscaping island 50 of FIG. 8, showing how varying sizes of barrier elements 10 may effectively be used in forming a planter or landscaping island 50.

Figure 13:
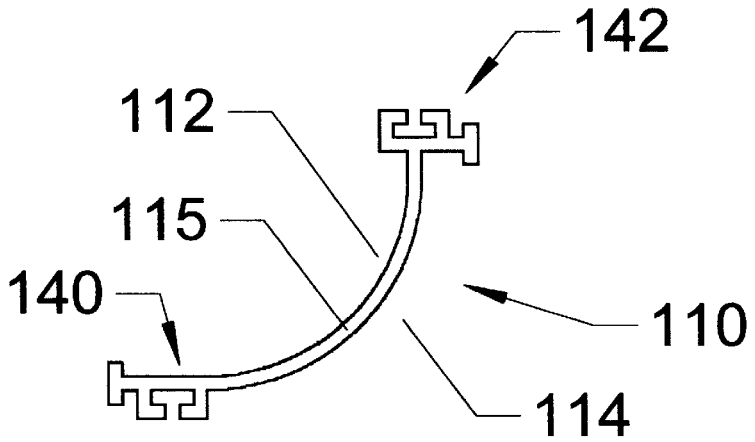
FIG. 13 is a plan view of the barrier element of FIG. 12.

Referring now to FIGS. 11–26, a second preferred embodiment of the present invention is shown. In this embodiment, as shown in FIG. 13, the barrier element 110 incorporates a pair of connectors 140, 142 which allow for a multitude of different configurations to be assembled. In particular, the barrier element 110 may be combined as in the first embodiment to create an embankment retaining wall or landscaping island, or may be configured to create containers for holding granular material.

Figure 11:
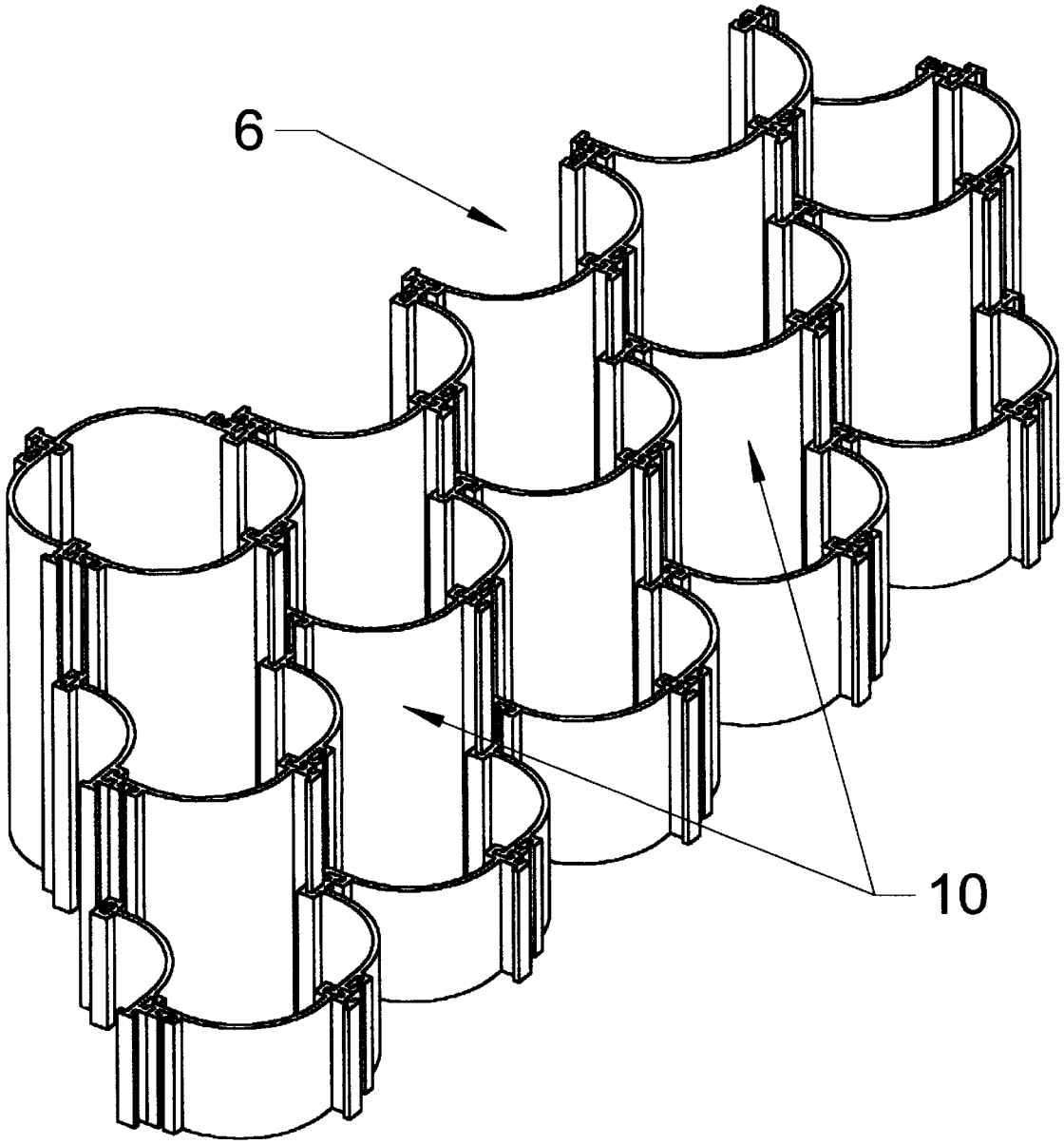
FIG. 11 is a perspective view of a segment of installed barrier elements in accordance with a second preferred embodiment of the present invention.
Figure 12:
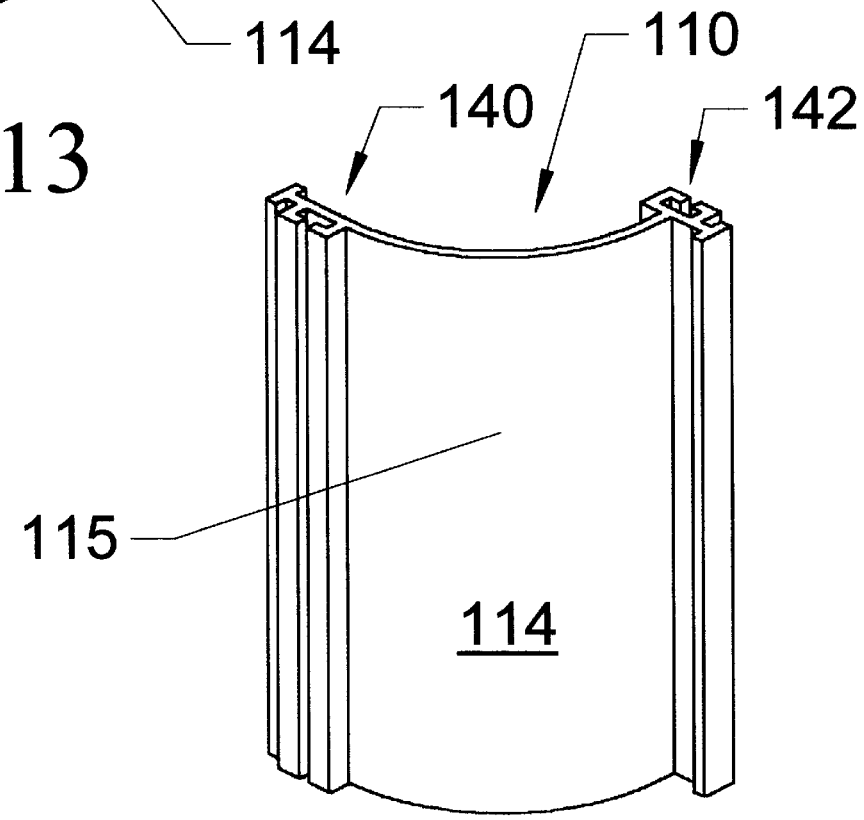
FIG. 12 is a perspective view a single barrier element in accordance with the second preferred embodiment of the present invention.

Referring to FIG. 11, a perspective view of a material containment system 6 is shown. The system 6 can be installed along and down a slope for slope stabilization or can be freestanding to allow for the creation of an island. The system is built by the interconnection of a number of barrier elements or elements 110, as shown in FIGS. 12 and 13. It can be seen that the system can be installed to conform to the three dimensional shape of the slope by freely varying the elevation of each barrier element as desired within a row and/or between rows.

Turning to the barrier element 110, FIGS. 12 and 13 show a perspective and plan view, respectively, of a single barrier element 110. As shown in FIG. 13, each barrier element 110 is composed of a wall or member 115 having, preferably, a quarter-circle horizontal cross-section. The wall, therefore, has a concave surface 112 and a convex surface 114. The element 110 has constant dimensions along the total vertical length of the element 110. It is important to note, however, that the member 115 may take a variety of shapes to create different visual looks for the assembled system without departing from the scope of the present invention. For instance, the member 115 could be angled, wavy, planar, corrugated, parabolic, etc.

Figure 14:
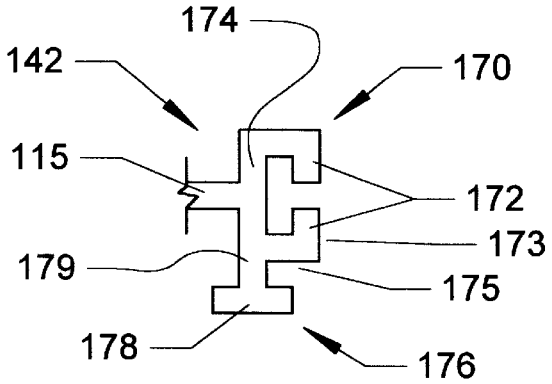
FIG. 14 shows a transverse section of a first connector of the barrier element in accordance with the second preferred embodiment of the present invention.
Figure 15:
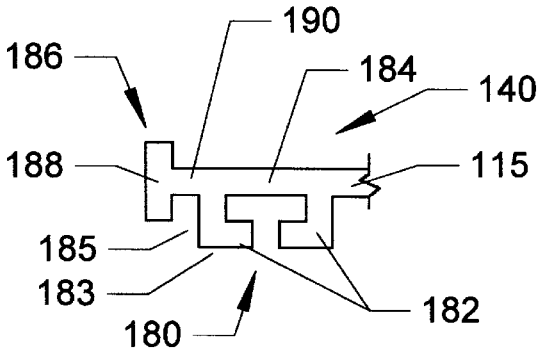
FIG. 15 shows a transverse section of a second connector of the barrier member in accordance with the second preferred embodiment of the present invention.

Referring to FIGS. 14 and 15, the connector system of the barrier element 110 is shown in greater detail. In the preferred embodiment, one connector 140 and one connector 142 are located at opposite ends of the member 115. However, it should be noted that only one connector may be provided if desired, e.g., when the system 6 is to end at a wall of a building.

Each connector 140, 142 includes a complementary female portion or form 170, 180 and a male portion or form 176, 186. In a preferred embodiment, the female portions are C-shaped and the male portions are T-shaped. The connector 142, is generally referred to as a perpendicular T&C connector because the back of the "C" portion 174 and the stem 179 of the "T" portion 176 are perpendicular to, the centerline of the member 115. The connector 140 is generally referred to as a parallel T&C connector because the back of the "C" portion 184 and the stem 190 of the "T" portion 186 are aligned, i.e., in line and parallel, to the centerline of the member 115. In both the parallel and perpendicular T&C connector, it is preferable to have the back of the "C" portion 174, 184 constitute or overlap at least a portion of the stem 179, 190 of the "T" portion 176, 186. The particular elements of the connectors are sized such that the head of the T-shape 178, 188 mates with the interior of the C-shape formed by arms 172, 182. In particular, each opening within the arms 172, 182 of the C-shapes is sized to wrap around the head 178, 188 of the T-shapes. Further, outer surfaces of the C-shape 172, 175, 183, 185 are the same length to accommodate having more than two barrier elements 110 connected together at one juncture as will be described below.

It is important to note, that while the preferred embodiment is shown with T-shaped and C-shaped connectors, other shapes are equally applicable without departing from the scope of the invention. For instance, mating dovetail, circles, or triangular shapes, etc. may be used.

In the preferred embodiment, one parallel T&C connector 140 is used at one end of the member 115 and one perpendicular T&C connector 142 is used at the opposing end of the member 115. It should be recognized, however, that two connectors on one member 115 may be identical if desired for proper interconnection. Also, in the preferred embodiment, the connectors 140, 142 extend the full length of the barrier wall 115. However, it should be noted that the connectors 140, 142 may be foreshortened if necessary, e.g., to accommodate outcroppings in an embankment or island.

Manufacturing-wise, it has been found preferable to use extruded plastic material to form the barrier elements 110, but alternate methods of production and types of materials could be used. For instance, plastic elements could be injection molded, or materials such as sawdust-resin mixtures could be extruded to create bio-degradable elements. Further, the connectors 140, 142 and member 115 could be fabricated independently, and possibly of different materials, and then attached to one another to create complete elements 110. For example, fabricated steel connectors could be embedded in cast concrete element walls to create a complete element.

Figure 16:
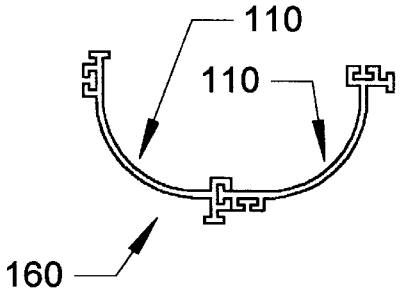
FIG. 16 shows a first configuration of interconnected barrier elements in accordance with the second preferred embodiment of the present invention.
Figure 17:
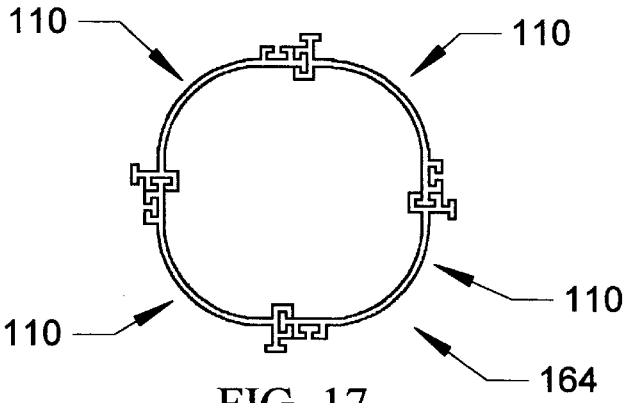
FIG. 17 shows a second configuration of interconnected barrier elements in accordance with the second preferred embodiment of the present invention.
Figure 18A:
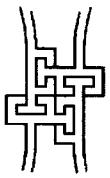
FIGS. 18A–18D show a variety of configurations that are achievable by interconnecting barrier elements in accordance with the second embodiment of the present invention.
Figure 18B:
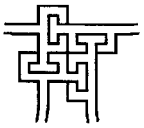
Figure 18C:
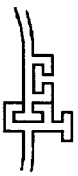
Figure 18D:
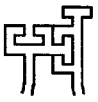

Referring to FIGS. 16, 17 and 18A–18D, groupings of barrier elements that form the basic geometric patterns of a system for stabilizing an embankment or creating a container are shown. FIG. 16 shows a two-element semicircular set 160 and FIG. 17 shows a four-element circular set that creates a container 164. From these drawings, the advantages of the present invention are readily recognizable. That is, the provision of a male and female component on the end of each barrier element 110 allows for neighboring barrier elements 110 to be joined not just in line, as shown in FIG. 18C, but also in a variety of other interconnection schemes. For instance, the male/female connectors 140, 142 allow for tangential connections of two to four barrier elements as exemplified by FIGS. 18A and 18D. Further, the male/female connectors 140, 142 allow for perpendicular connections of neighboring barrier elements 110 as exemplified by FIG. 18B. With this large variety of interconnection schemes the possibilities of the types of barrier and containment systems that can be created become virtually limitless.

Referring to FIGS. 19–23, a variety of the interconnection schemes and the overall structures that can be created using the second preferred embodiment are shown. A first possible scheme that can be constructed would be similar to that of FIG. 4 which shows a typical installation 5 of similar barrier elements 10 for retaining material, such as an embankment. The FIG. 4 installation 5 of the first preferred embodiment, and similarly the second embodiment, is the configuration used to armor a slope to protect it from erosion and/or create interconnected cascading planters in which to grow vegetation for soil stabilization, agricultural or aesthetic purposes. Erosion protection is provided by directing large flows of water down the slope in short waterfall steps to reduce flow velocities accompanied by the use of either a non-erodible infill material such as gravel of sufficient size or concrete, or the use of soil infill shielded by the foliage of vegetation and reinforced by the root systems of vegetation. In addition, infill materials (non-erodible or soil) can be chosen to reduce water penetration into a supporting soil slope to deter the saturation of the slope's soil and the possibility of the sloughing of the slope's surface which could be induced if the supporting soil slope was allowed to become saturated.

Figure 19:
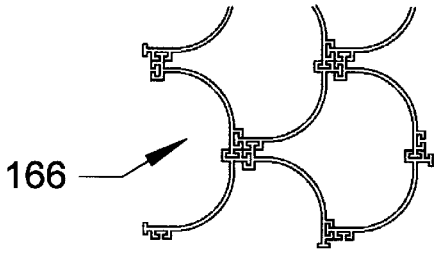
FIG. 19 shows a barrier structure created by interconnection of barrier elements in accordance with the second embodiment of the present invention.
Figure 20:
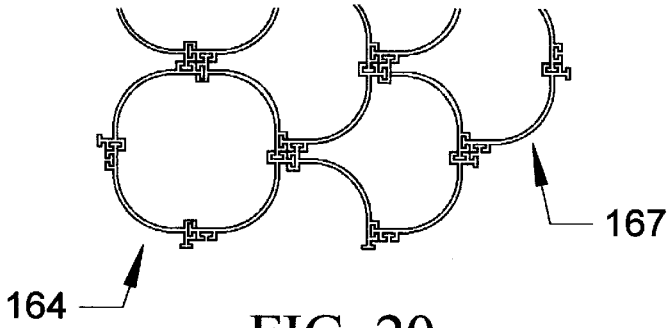
FIG. 20 show a freestanding structure created by interconnection of barrier elements in accordance with the second embodiment of the present invention.
Figure 21:
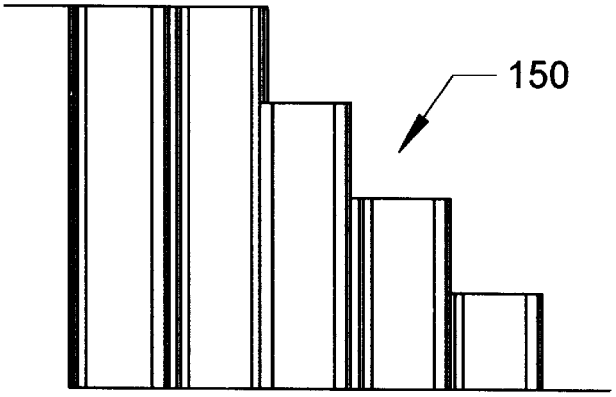
FIG. 21 shows a side view of the structure of FIG. 20.

FIG. 19 shows, in plan view, a system 166 most often used to armor an embankment while FIG. 20 shows a system 167 with containers 164 created in one row. FIG. 21 shows a side view of FIG. 20 wherein elements of varying lengths are used in each row with all of the rows installed with their bases resting on the same supporting surface. The erosion protection and infill options available with the arrangements of FIGS. 19–21 are similar to those described for FIG. 4 above.

Figure 22:
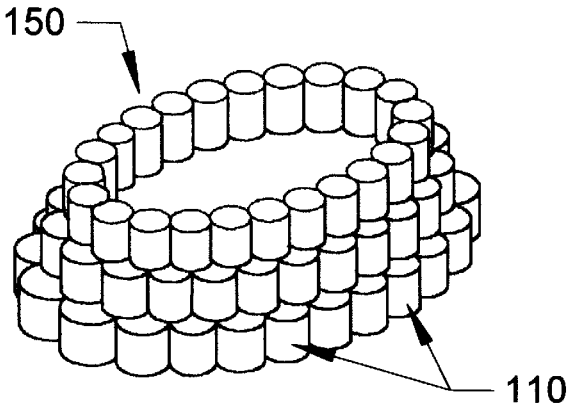
FIG. 22 shows a freestanding granular material containment structure for forming an island of granular material and which uses barrier elements in accordance with the second preferred embodiment.

FIG. 22 shows a plurality of barrier elements 110 interconnected to create a landscaping island 150 by arcing the interconnected rows of elements 110 back around to connect with themselves using the flexibility of the individual elements 110 to do so. The barrier elements 110 are used to armor the slopes of the landscaping island, or alternatively to create a gravity retaining wall to act as an embankment to retain fill forming the island 150 as shown in FIG. 21.

Figure 23:
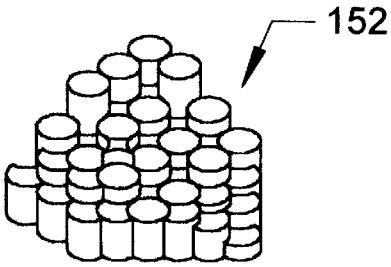
FIG. 23 shows a freestanding granular material containment structure for forming an island of material containers and which uses barrier elements in accordance with the second preferred embodiment.

FIG. 23 shows a small landscaping island 152 that creates planters. In this setting, no material may be retained beyond the material that actually infills the voids between the barrier elements, if desired.

Figure 24:
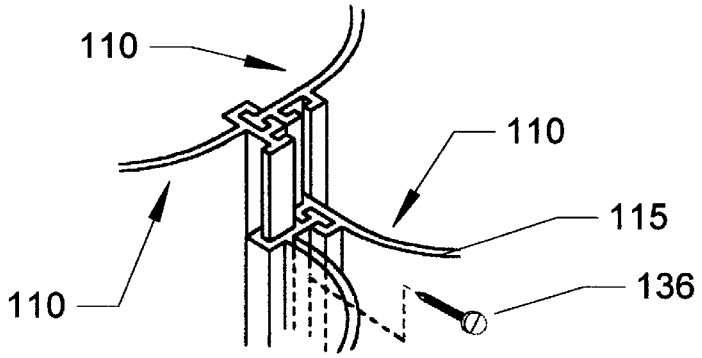
FIG. 24 shows a perspective view of a barrier element configuration in accordance with the present invention and a fastener to affix the relative location of the elements.

FIG. 24 shows the placement of a fastener 136 through an interconnection of a plurality of barrier elements 110 to fix the relative position of the barrier elements. The fastener 136 is positioned close to the top edges of two barrier elements. However, the fastener 136 may be used wherever necessary.

Figure 26:
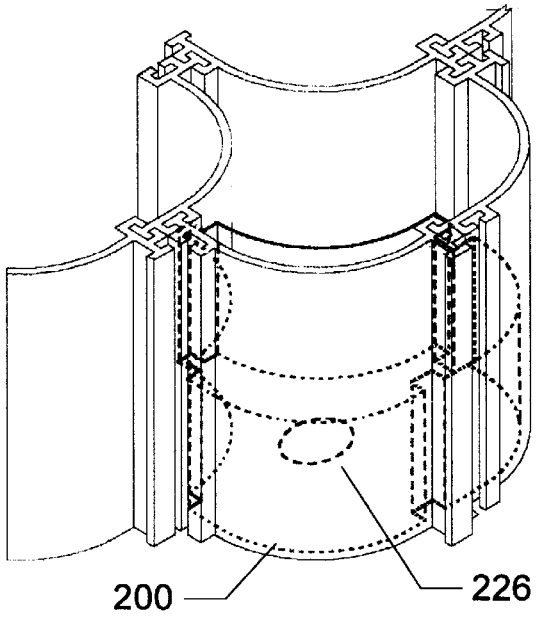
FIG. 26 shows the draining base plug accessory of FIG. 25 in position within a barrier element configuration in accordance with the present invention.
Figure 25:
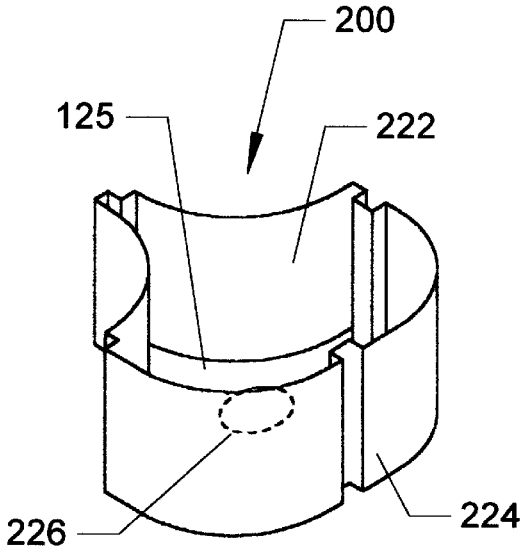
FIG. 25 shows a draining base plug accessory for retaining the infill within a configuration of barrier elements in accordance with the present invention.

Referring to FIGS. 25 and 26, a draining base plug 200, similar to that of FIG. 5 of the first preferred embodiment, is shown. The drainage base plug 200 is sized and shaped to be positioned at the base of a four-barrier element system shown in FIG. 26. The drainage base plug 200 generally includes a vertical side 224 forming a filler space 222 and shaped to comport with the interior of the interconnected barrier elements, a bottom 125 and a drainage hole 226. It should be recognized that the particular shape of the drainage plug 200 has been shown for illustration purposes only. The drainage plug 200 can be shaped to fit in the bottom of any of the possible shapes that can be created by the barrier elements 110 in accordance with this invention.

The barrier elements and system of the present invention offers a unique solution to the problem of stabilizing steeply sloped earthen surfaces, and creating material containment structures for granular and formed materials. Interlocking barrier elements 110 can be used in geometric patterns to control soil slope or soil embankment sloughing or erosion, conforming the systems shape to the needs of the installation rather than having the installation conform to the limits of the system.

The system additionally provides a way of creating variable sized formable material containment structures for a wide range of uses including the storage or forming of materials, e.g., cement, or the creation of granular material containment structures capable of performing the functions of similarly sized earthen structures, e.g., earthen embankments, walls, islands, mounds, planters, etc. However, the resultant system exhibits increased resistance to erosion due to the structure's surface armoring provided by the system's barrier elements 110 and increased internal strength due to the interconnected grid of barrier elements 110 throughout the structure. The system's lightweight components make it usable in inaccessible locations and without the use of heavy construction equipment. And the simplicity of the system, with only one major element and several accessories, will make its production and user costs non-prohibitive.

The foregoing description of the preferred embodiments of this invention has been presented for purposes of illustration and description. It is not intended to be exhaustive or to limit the invention to the precise form disclosed, and obviously many modifications and variations are possible in light of the above teaching. For example, the colors of the containment elements could be changed to make them stand out or blend into the color of the surrounding landscape. Further, the system could be assembled to form a channel cross-section dropping down a slope or forming the bed of a waterway, which when infilled with stone or concrete could control water flow and scouring with the added benefit that the stepped configuration of the rows of the system will reduce the flow velocity of water running down the channel. Accordingly, such modifications and variations that may be apparent to a person skilled in the art are intended to be included within the scope of this invention as defined by the accompanying claims.

We claim:

1. A barrier element comprising:

a barrier member; and a connector positioned on each end of the barrier member, each connector having a T-shaped male portion and a complementary C-shaped female portion, wherein one connector has a back of the C-shape and a stem of the T-shape aligned with the barrier member such that the back of the C-shape constitutes at least a portion of the stem of the T-shape.

2. The barrier element of claim 1, wherein both connectors have a back of the C-shape and a stem of the T-shape aligned with the barrier member such that the back of the C-shape constitutes at least a portion of the stem of the T-shape.

3. The barrier element of claim 1, wherein the other connector has a back of the C-shape and a stem of the T-shape perpendicular with the barrier member.

4. The barrier element of claim 3, wherein the back of the C-shape constitutes at least a portion of the stem of the T-shape.

5. The barrier element of claim 1, wherein the barrier member is scallop shaped.

6. The barrier element of claim 1, further comprising at least one fastener to be inserted into the connectors to secure barrier elements together.

7. The barrier of claim 1, further comprising an infill drainage plug having the shape of a void created between interlocking barrier elements.

8. The barrier element of claim 7, further comprising a fastener to fix in place the infill drainage plug at the base of the void created between barrier members.

9. A system for containing formable material comprising:

a plurality of a barrier members each having a connector on each end thereof, each connector having a male T-shaped portion and a complementary C-shaped female portion with one connector having a back of the C-shape and a stem of the T-shape aligned with the barrier member such that the back of the C-shape constitutes at least a portion of the stem of the T-shape, wherein the barrier members interconnect with one another.

10. The system of claim 9, wherein both connectors have a back of the C-shape and a stem of the T-shape aligned with the barrier member such that the back of the C-shape constitutes at least a portion of the stem of the T-shape.

11. The system of claim 9, wherein the other connector has a back of the C-shape and a stem of the T-shape perpendicular with the barrier member.

12. The system of claim 11, wherein the back of the C-shape of the other connector constitutes at least a portion of the stem of the T-shape of the other connector.

13. The system of claim 9, wherein the barrier member is scallop shaped.

14. The system of claim 9, further comprising at least one fastener to be inserted into the connectors to secure the barrier members together.

15. The barrier of claim 9, further comprising an infill drainage plug having the shape of a void created between interlocking barrier members.

16. The system of claim 15, further comprising a fastener to fix in place the infill drainage plug at the base of the void created between barrier members.

17. A method for formable material containment comprising the steps of:

providing a plurality of barrier members each having a connector on each end thereof, each connector having a T-shaped male portion and a complementary C-shaped female portion with one connector on each barrier member having a back of the C-shape and a stem of the T-shave aligned with the barrier member such that the back of the C-shape overlaps at least a portion of the stem of the T-shape; and forming a series of compartments by interconnecting the barrier members.

18. The method of claim 17, wherein the other connector on each barrier member has a back of the C-shape and a stem of the T-shape perpendicular with the barrier member.

19. The method of claim 18, wherein the back of the C-shape of the other connector overlaps at least a portion of the stem of the T-shape of the other connector.

20. The method of claim 17, wherein the step of providing a plurality of barrier members includes providing scallop shaped barrier members.

21. The method of claim 17, further comprising the step of inserting a fastener into the connectors to affix the barrier members together.

22. The method of claim 17, wherein the step of interconnecting barrier members includes mating the T-shaped male portions of connectors with an interior of the C-shaped female portions of connectors.

23. A connector system for members to be connected together, the system comprising:

a member; and a connector positioned on each end of the member, each connector having a T-shaped male portion and a complementary C-shaped female portion, wherein one connector has a back of the C-shape and a stem of the T-shape aligned with the member such that the back of the C-shape constitutes at least a portion of the stem of the T-shape.

24. The connector system of claim 23, wherein the other connector has a back of the C-shape and a stem of the T-shape perpendicular with the member.

25. The connector system of claim 24, wherein the back of the C-shape of the other connector constitutes at least a portion of the stem of the T-shape of the other connector.

26. The connector system of claim 23, wherein the member is scallop shaped.

27. The connector system of claim 23, further comprising at least one fastener to be inserted into the connectors to secure members together.

28. A barrier element comprising:

a barrier member; and a first connector and a second connector positioned, one on each end, of the barrier member, each connector having a T-shaped male portion and a complementary C-shaped female portion, wherein the first connector has a back of the C-shape and a stem of the T-shape aligned with the barrier member, and the second connector has a back of the C-shape and a stem of the T-shape perpendicular with the barrier member.

29. A system for containing formable material comprising:

a plurality of a barrier members each having a first connector positioned on one end and a second connector positioned on the other end, each connector having a T-shaped male portion and a complementary C-shaped female portion, wherein the first connector has a back of the C-shape and a stem of the T-shape aligned with the barrier member, and the second connector has a back of the C-shape and a stem of the T-shape perpendicular with the barrier member, and wherein the barrier members interconnect with one another by connecting the T-shapes and the C-shapes together.

30. A connector system for members to be connected together, the system comprising:

a member;

a first connector having a T-shaped male portion and a complementary C-shaped female portion positioned on one end of the member, a back of the C-shape and a stem of the T-shape being aligned with the member; and a second connector having a T-shaped male portion and a complementary C-shaped female portion positioned on the other end of the member, a back of the C-shape of the second connector and a stem of the T-shape of the second connector being perpendicular with the member, and wherein members are interconnected with one another by connecting the T-shapes and the C-shapes together.

* * * * *